US007641196B2

(12) United States Patent
Dowding

(10) Patent No.: US 7,641,196 B2
(45) Date of Patent: Jan. 5, 2010

(54) BOARD GAME

(76) Inventor: Paul F. Dowding, 48 Old Branchville Rd., Ridgefield, CT (US) 06887

( * ) Notice: Subject to any disclaimer, the term of this patent is extended or adjusted under 35 U.S.C. 154(b) by 0 days.

(21) Appl. No.: 11/198,010

(22) Filed: Aug. 5, 2005

(65) Prior Publication Data

US 2007/0029728 A1 Feb. 8, 2007

(51) Int. Cl.
*A63F 3/00* (2006.01)

(52) U.S. Cl. ..... 273/258; 273/255

(58) Field of Classification Search ..... 273/258, 273/260, 261, 255, 262
See application file for complete search history.

(56) References Cited

U.S. PATENT DOCUMENTS 1,216,355 A * 2/1917 Persyn ..... 273/263
3,642,286 A * 2/1972 Moore ..... 273/243
3,881,731 A * 5/1975 Droney ..... 273/291
4,687,206 A 8/1987 Cordry et al.
4,728,107 A 3/1988 Dvorak et al.
4,739,992 A * 4/1988 May ..... 273/243
5,033,753 A 7/1991 Yuen et al.
5,657,990 A * 8/1997 Patel ..... 273/263
6,588,752 B2 7/2003 Mickowski
6,623,008 B1 9/2003 Reed, Jr. et al.
6,702,287 B1 3/2004 Pendexter
6,719,289 B1 * 4/2004 Brown et al. ..... 273/260
6,808,172 B2 10/2004 Bedford et al.
6,886,831 B2 5/2005 Tolany et al.
6,893,019 B2 5/2005 Gaygen

* cited by examiner

*Primary Examiner*—Vishu K. Mendiratta
(74) *Attorney, Agent, or Firm*—Wolf & Samson, PC

(57) ABSTRACT

A game and method including providing a game board having a plurality of nodes, a source node for each player and a plurality of playing pieces. Each piece has multiple states and represents each state. The game is played by starting the playing pieces via a single starting position, and moving the pieces by each player, in turn, by having one of the player's pieces act on another of the player's own pieces, a piece of another player, or an empty node according to its predetermined movement abilities and then removing the acting piece. The player backfills the empty node with another piece linked to the emptied node, and continuing to the player's source node. Finally a new piece is placed on the source node in any chosen state. Play continues until one player removes a piece from another player's source node.

10 Claims, 11 Drawing Sheets

BOARD GAME

BACKGROUND OF THE INVENTION

The invention relates to a game, more particularly to a strategic board game. Conventional strategic board games, such as checkers and chess, involve two players who move their game pieces across a game board in an attempt to capture or trap the game pieces of the other player.

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Board games like Chess, Backgammon, Checkers, and Othello had not been invented for centuries, if not millennia, and all but one person in the world can be beaten by a computer playing Chess. It was therefore desired to create a game as mentally demanding and fulfilling as Chess, in order to meet the test of the ages, and to create a game where the probable outcomes were infinite and so could not be easily mastered by a computer program.

In these respects, the game and method of playing the same according to the present invention substantially departs from the conventional concepts and designs of the prior art. In the present game, while infinite variability may be impossible, near infinite variation of different probabilistic outcomes may have (or at least probably) been achieved.

SUMMARY OF THE INVENTION

The primary object of the present invention is to provide game and method of playing the game. The game and method include providing a game board, the board comprised of a plurality of nodes, providing a source node for each player and providing a plurality of playing pieces, the playing pieces each having a plurality of states, the playing pieces representing each of the states. Each piece has predetermined movement abilities, according to the state of each piece. The game is played by assigning a plurality of distinguishable playing pieces to a plurality of players, positioning the playing pieces on the spaces of the board in a starting position, and moving the pieces by each player, in turn, by having one of the player's playing pieces act on another of the player's own pieces, a playing piece of another player, or an empty node according to its predetermined movement abilities as characterized by its current state, and then removing the acting piece. Then the player backfills the empty node with another of the player's own pieces directly linked to the newly emptied node, and continuing to the player's source node. Finally, a new piece is placed on the player's own source node in any state the player chooses. Play continues until one player's piece is removed from the player's source node by the other player.

BRIEF DESCRIPTION OF THE DRAWINGS

A preferred embodiment of the invention will now be described with reference to the accompanying drawings in which.

DETAILED DESCRIPTION OF THE INVENTION

Detailed descriptions of the preferred embodiment of the invention are provided herein. It is to be understood, however, that the present invention may be embodied in various forms. The present invention is generally directed to a board-game.

Figure 1:
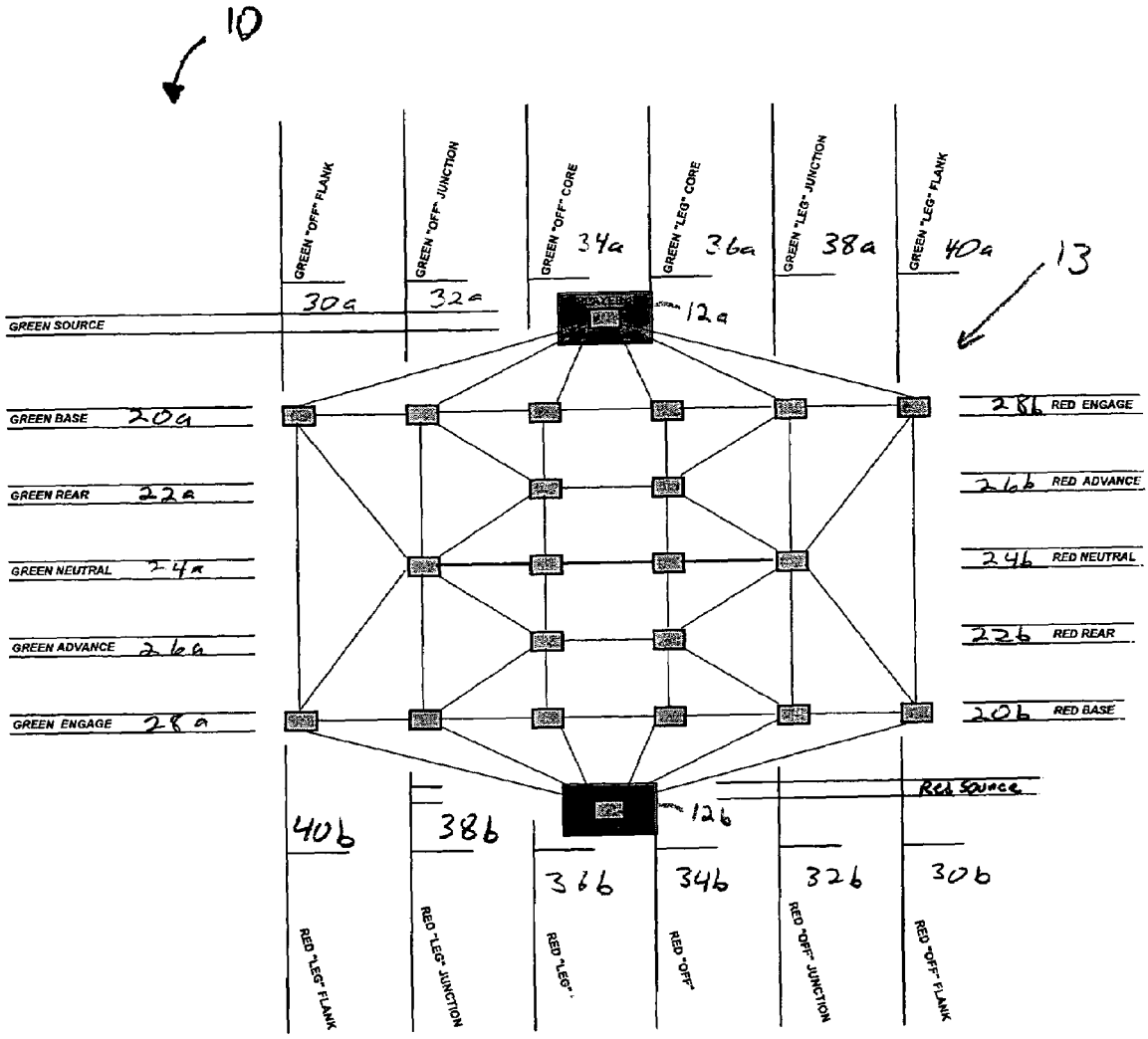
FIG. 1 is a schematic diagram of a two-player board of the game of the present invention.

As shown in FIG. 1, the board 10 of the game consists of one Source Node 12*a* and 12*b* for each player joined by a Lattice of Nodes 13 in various patterns. Each player has Pieces 14, as shown in FIG. 2, to move around the board 10 via the Nodes 13. A player can create Pieces 14 from his or her Source Node 12*a* and 12*b*. The Pieces 14 each have six sides 16*a*-16*f*. A player can define the State of the Pieces 14 as symbolized by the sides 16*a*-16*f* of the pieces 14 from the source node 12*a* and 12*b* also.

As also shown in FIG. 1, the Base Line 20 is the line of nodes 13 immediately in front of the player's Source Node 12. The Rear Line 22 is the line of nodes 13 immediately in front of the player's Base line 20. The Neutral Line 24 is the line of nodes 13 immediately in front of the player's Rear Line 22. The Advance Line 26 is the line of nodes 13 immediately in front of the player's Neutral Line 24. The Engage Line 28 is the line of nodes 13 immediately in front of the player's Advance Line 26, and also in front of the opponent's Source Node 12*a*, 12*b*.

Figure 3:
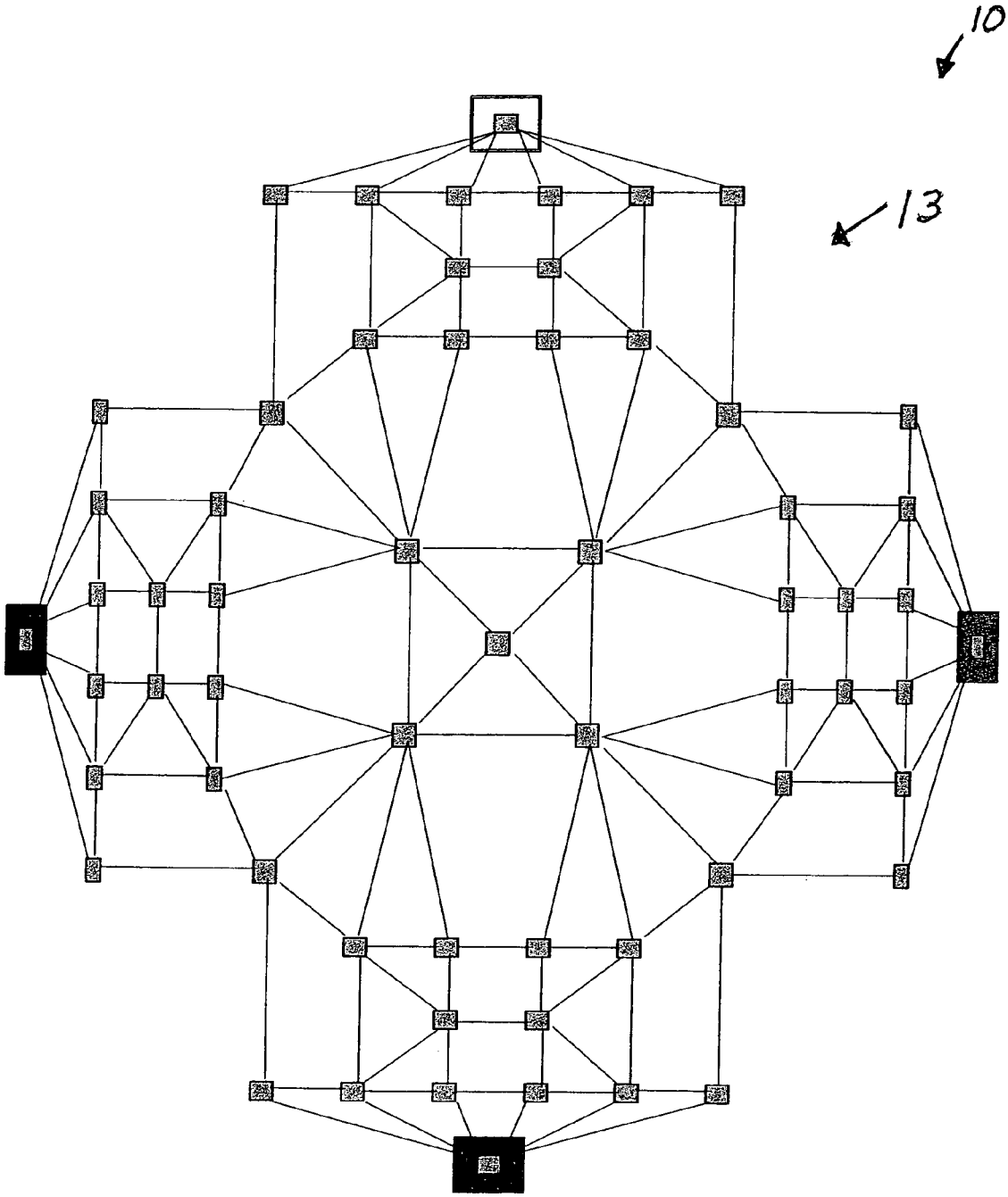
FIG. 3 is a schematic diagram of a four-player board of the game of the present invention.

A player's Leg Flank is the line of nodes 13 to the far left of the player's Source Node 12*a*, 12*b*. A player's Leg Junction 38 is the line of nodes 13 to the right of the player's Leg Flank 40. A player's Leg Core 36 is the line of nodes 13 to the right of the player's Leg Junction 38. A player's Off Keep 34 is the line of nodes 13 to the right of the player's Leg Core 36. A player's Off Junction 32 is the line of nodes 13 to the right of the player's Off Core 34. A player's Off Flank 30 is the line of nodes 13 to the right of the player's Off Junction 32, or the line of nodes to the far right of the player's Source Node 12*a*, 12*b*. As shown in FIG. 3, depending on the configuration of the board 10, there can be multiple Lattices of nodes 13 for different numbers of players.

Figures 2A, 2B, 2C, 2D, 2E, 2F:
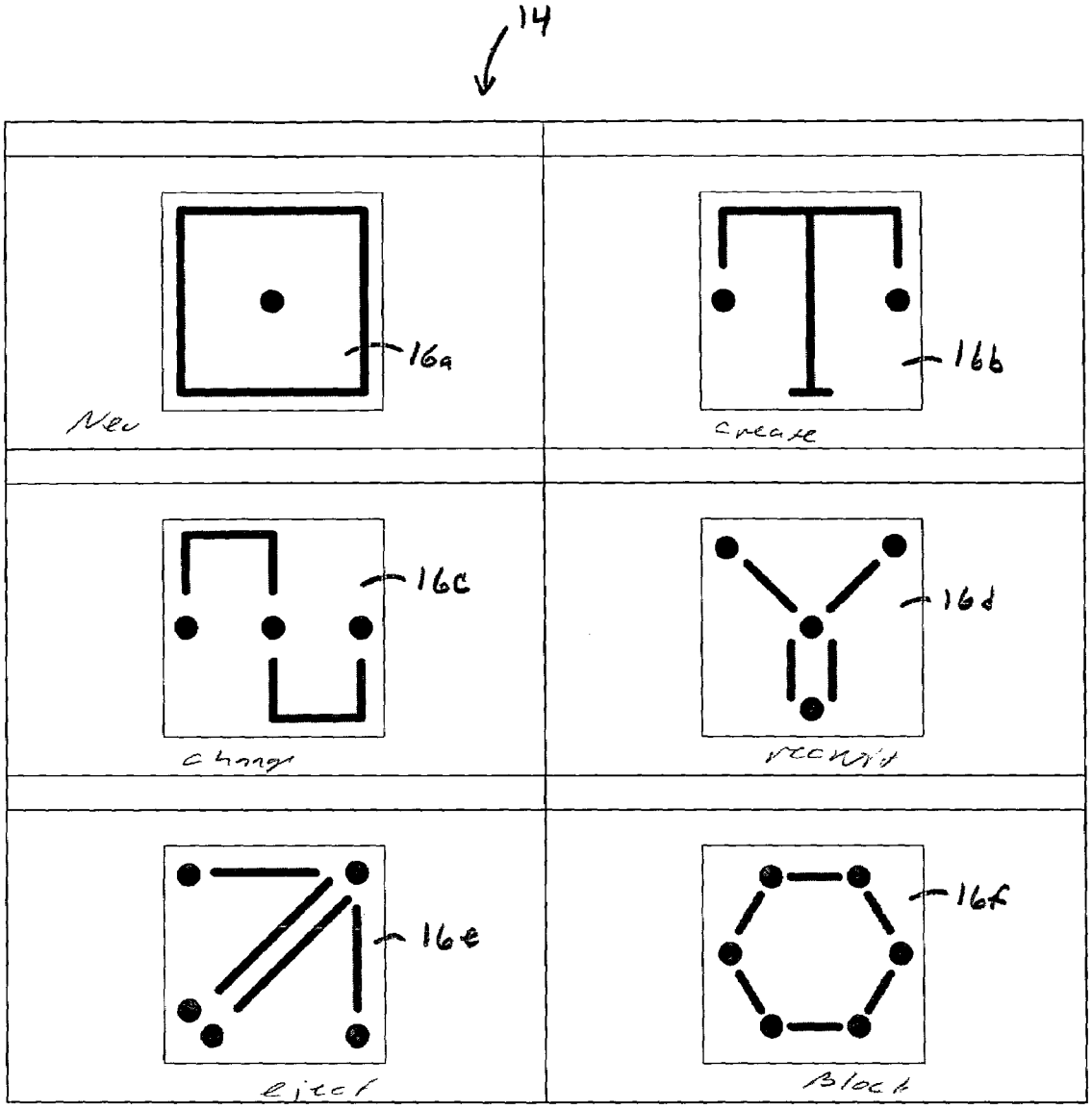
FIG. 2 is a schematic diagram of the sides of the pieces of the game of the present invention.

The pieces 14 on the board are all the same but may exist in one of six states. Each state determines how that piece 14 can affect either the player's own pieces 14 or the opponent's pieces 14 or any empty nodes 13. Each Piece 14 can assume any one of six States. The six States and the inherent properties of each State are shown in FIGS. 2*a*-2*f*. As shown in FIG. 2*a*, side 16*a* of piece 14 represents the Neutral state (1), meaning that the piece 14 can do nothing. Side 16*b* of piece 14 represents the Create state (2) meaning that the piece 14 creates a new piece 14 on an empty node 13 in the Neutral state (1). Side 16*c* of piece 14 represents the Change state (3), meaning the player may change the player's own piece 14 to any other state. Side 16*d* of piece 14 represents the Recruit state (4), meaning that the player may change an opponent's piece, of state (4) or less, to the player's piece 14 of neutral state (1). Side 16*e* of piece 14 represents the Eject state (5) causing an opponent's piece 14, of state (5) or less, to be removed from the board 10.

Side 16*f* of piece 14 represents the Block state (6) meaning the player can "eject" an opponent's piece 14 of state (6) only. A "state (6) or block state 16*f* can not be affected y an opponent's piece 14 in a state (5), eject 16*e* or less and so is primarily used as a locking mechanism.

These states are summarized in the table below:

| Fig. | State# | State | Acts Upon | Result of Action | Can not Act Upon |
|---|---|---|---|---|---|
| 16a | 1 | Neutral | Nothing | — | Any other Piece or an empty Node |
| 16b | 2 | Create | Empty Adjacent Node | Fills adjacent Node with New Piece in Neutral State 1 | Other Pieces or any occupied Nodes |
| 16c | 3 | Change | Player's own Pieces | Changes State of Piece to any other State | Opponent's Pieces or an empty node |
| 16d | 4 | Recruit | Opponent's Pieces in States '4' or less | Changes Opponent's Piece to Player's Piece in Neutral State | Any Player's own Pieces an empty node or Opponent's Pieces in States 5 or 6 |
| 16e | 5 | Eject | Opponent's Pieces in States '5' or less | Removes Opponent's Piece and leaves empty Node | Any Player's own Piece, an empty node or Opponent's Pieces in State 6 |
| 16f | 6 | Block | Opponents Piece in "Block" State 6 using "sacrifice" maneuver | Sacrifice allows the player to eject the opponents' "6"using his or her own "6" | Any Player's own Pieces, an empty node or Opponent's Pieces in State 1 thru 5 |

The game uses an untraditional means to advance a player's pieces 14 up the board 10. Apart from one exception, players progress forward by adding pieces 14 and changing their states to suit their intentions or guard against the opponent's intentions. There are only two ways for a player to increase the number of his or her pieces 14 on the board. First, by creating new pieces 14 or, second, by recruiting the opponent's pieces 14. Each player begins the game with only one piece 14 on their Source Node 12*a* and 12*b*.

The object of the game is for each player to advance his or her Pieces 14 towards the opponent's Source Node 12*a*, 12*b* and neutralize it by using the different states of his or her Pieces 14. In the game, the players try to defeat each other by overpowering each others Source Node 12*a*, 12*b*, which is the primary, but not the only, source of each player's pieces 14. It is a tactical fight that requires strategic thinking to win. The game contains paradox of any battle; victory can not be achieved by standing your ground and any advance may weaken your defense.

Each player alternates in taking one turn at a time. A player's turn consists of three elements: The use and removal of a player's piece 14, the backfill process, and the placement of a new piece 14 on the empty source node 12*a*, 12*b*. For one turn a player may select any one of his or her Pieces 14 to act on of either his or her Piece 14, the opponent's Piece 14 or an immediately adjacent Node 13, according to the properties of the selected Piece's 14 State as defined above. The "acting" piece 14 is then removed from the board 10 creating an empty node 13.

The player can then backfill the empty node 13 with another piece 14 directly linked to the newly emptied node 13, creating the next empty node 13. The original selected Piece 14 must be linked to the Source Node 12*a*, 12*b* by a continuous chain of its own Pieces 14 in order to be used in a turn. The backfilled piece 14 can then be backfilled by another piece 14 on an node 13 immediately adjacent to its original node 13 to fill that empty Node 13. This process can keep recurring in a continuous trail back to the player's source node 12*a*, 12*b* until the player moves his or her Source Node Piece 12*a*, 12*b*. The path of the backfilling process must not touch any node 13 more than once and can only be achieved by using successive nodes 13 in a direction towards the source node 12*a*, 12*b* or perpendicular to the direction of play. The line of moved Pieces 14 from the original Piece 14 to the Source Node 12*a*, 12*b* must only be perpendicular to the direction of play or move closer to the Source Node 12*a*, 12*b*. Therefore, for a player's piece to be used in a move it has to be connected to the player's source node by a continuous line of its own pieces. An isolated piece is effectively helpless until a connection can be re-established The player can then put a new piece 14 on the source node 12*a*, 12*b* in any state the player chooses. The Source Node 12*a*, 12*b* is then filled with a new Piece 14 and can have, with limitations, any state as selected by the player. The player's turn then ends. The player's turn is officially over when his or her finger leaves the Piece 14 selected to occupy the Source Node 12*a*, 12*b*.

The thrust move is the only exception to the three elements of a move. The thrust move is a special move, which may be chosen as a players turn. For a thrust move, a player moves one of the pieces 14, unchanged, into an empty node 13 and the back fill process then occurs. The subsequent empty node 13 left by the piece 14 can be filled by the backfill process described above, except that the move ends on an empty node 13 adjacent to the Source Node 12*a*, 12*b*. The player can not move the Source Node piece 14 into that empty node 13 or change the Source Node piece 14 during the thrust move. After a thrust move an additional empty node 13 will be present on the base line.

Each Piece 14 in the chain of moved Pieces 14 may only be moved once in each turn. If the Source Node 12*a*, 12*b* is the original Piece 14 and has not acted on another piece 14 or Node 13, it can not remain at its current State and has to change to a different State. Until the Piece 14 on the Source Node 12*a*, 12*b* acts on another Piece 14 or Node 13, it can not repeat any State, which it has had, since the last time it acted upon another Piece 14 or Node 13. A player begins each game with a Piece 14 at his or her Source Node 12*a*, 12*b*. The first move by any player is to select the "Create" State as no other State can do anything without any other Pieces 14 to act upon.

The game consists of three phases: build up, engagement and attrition to victory/defeat. The "Build Up" is the initial process of each player filling the board 10 with pieces 14. "Engagement" begins when the players can interact with each other's pieces 14. "Attrition" begins when one or both players are "on his or her heels". This situation occurs when a player has managed to put a piece of eject state (5) on the opponent's base line 20. In this condition, in order to avoid losing, the opponent has to play Block state (6) on its Source Node 12*a*, 12*b* every turn, which over time will limit the opponent's opportunities to fight back as he or she will only be backfilling with pieces of Block state (6). Unless the opponent can put the other player on their heels or remove the Eject state (5), defeat is only a few moves away. If a player only changes the state of the piece 14 on the source node as a turn, the player can not repeat any state until he has moved a piece 14 off the source node 12*a*, 12*b* and replaced it with a new piece 14.

A player is eliminated when an opponent neutralizes his or her Source Node 12*a*, 12*b* by Recruiting, state (4) or Ejecting, state (5) the Piece 14 on the player's Source Node 12*a*, 12*b*. If more than two players are playing and a player recruits or places a Piece 14 on another player's Source Node 12*a*, 12*b*, the controlling player is said to occupy the source Node 12*a*, 12*b*. The player may then select to use that Source Node 12*a*, 12*b* or its original Source Node 12*a*, 12*b* in any of its future moves. A player with more than one Source Node 12*a*, 12*b* in his or her possession may only use one of its Source Nodes 12*a*, 12*b* for each turn.

A player wins the game when all other opponents' Source Nodes 12*a*, 12*b* are neutralized.

Figures 4A, 4B, 4C, 4D:
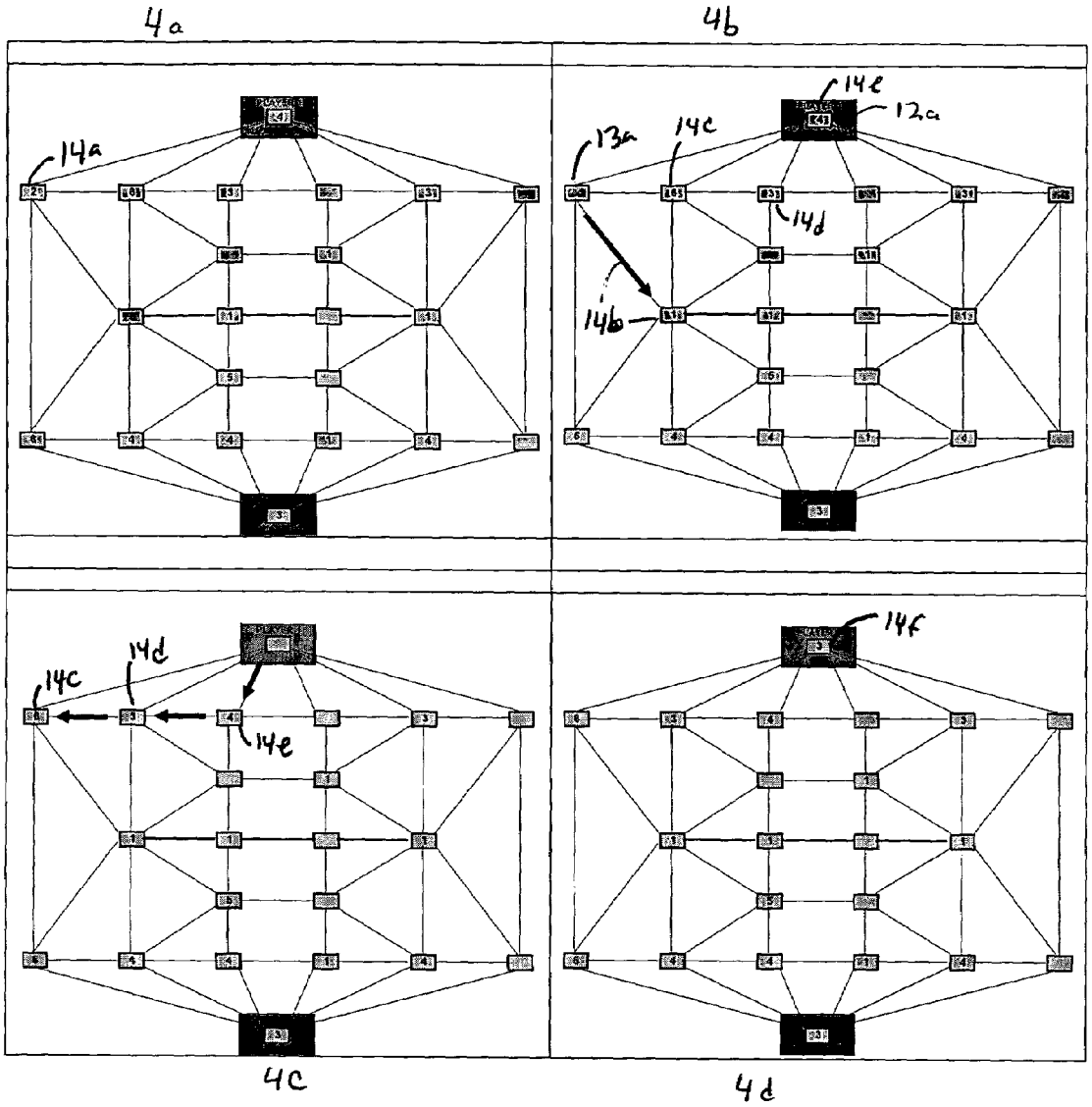
FIGS. 4*a*-4*d* are schematic diagrams of sample moves for a create.

The following will describe some sample moves to illustrate the game. FIGS. 4*a*-4*d* are schematic diagrams of sample moves for a create. FIG. 4*a* shows a sample starting position. In FIG. 4*b*, player 1 uses a piece 14*a* which was in create state (2) to create a piece 14*b* in neutral state (1) and then piece 14*a* is removed. The node 13*a* is then backfilled with piece 14*c*, and that node is backfilled with piece 14*d* and that node with 14*e* from the source node 12*a*. The player then places piece 14*f* in the source node 12*a*.

Figures 5A, 5B, 5C, 5D:
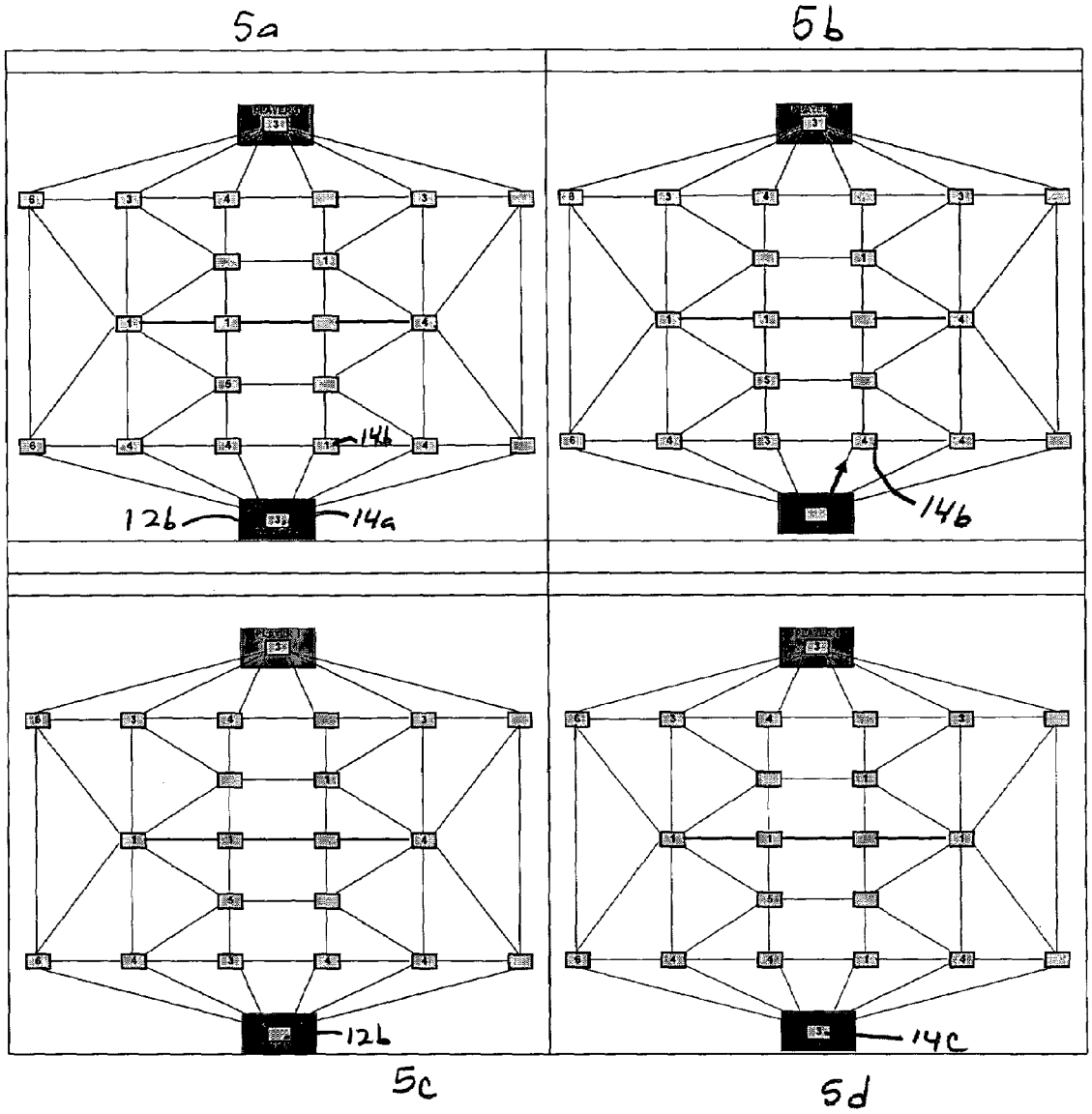
FIGS. 5*a*-5*d* are schematic diagrams of sample moves for a change.

FIGS. 5*a*-5*d* are schematic diagrams of sample moves for a change. FIG. 5*a* shows a sample starting position. In FIG. 5*b*, player 2 uses a piece 14*a* to change piece 14*b* to Recruit state (4) and then piece 14*a* is removed in FIG. 5*c*. As the source node 12*b* was the acting piece 14*a*, there is no backfill. As shown in FIG. 5*d*, the player then places piece 14*c* in the source node 12*b*.

Figures 6A, 6B, 6C, 6D:
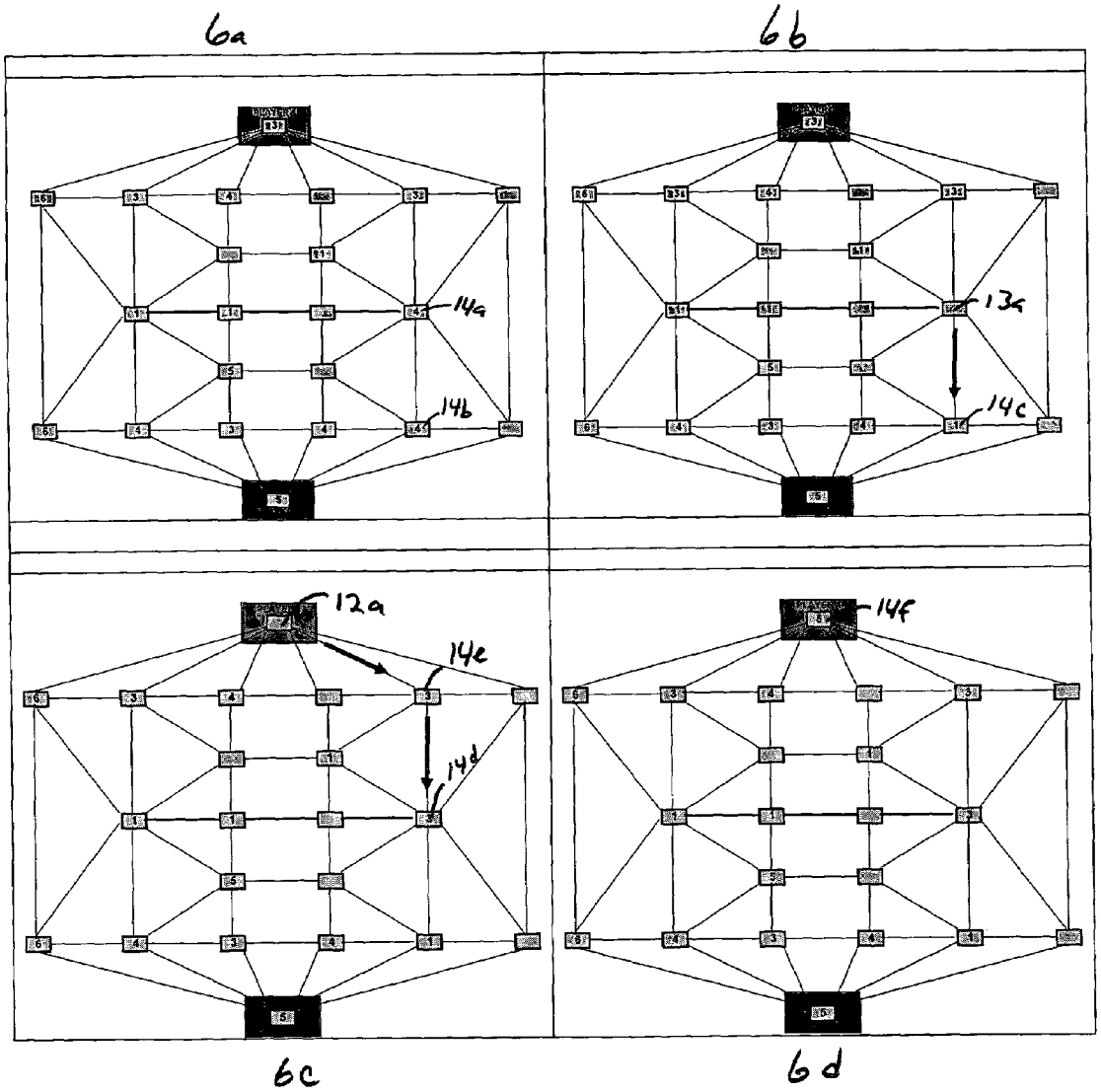
FIGS. 6*a*-6*d* are schematic diagrams of sample moves for a recruit.

FIGS. 6*a*-6*d* are schematic diagrams of sample moves for a recruit. FIG. 6*a* shows a sample starting position. In FIG. 6*b*, player 1 uses a piece 14*a* which was in recruit state (4) to recruit player 2's piece 14*b*. 14*a* is removed, and player 2's piece 14*b*, becomes player 1's new piece 14*c*. The node 13*a* is then backfilled with piece 14*d*, and that node is backfilled with piece 14*e*. The player then places piece 14*f* in the source node 12*a*.

Figures 7A, 7B, 7C, 7D:
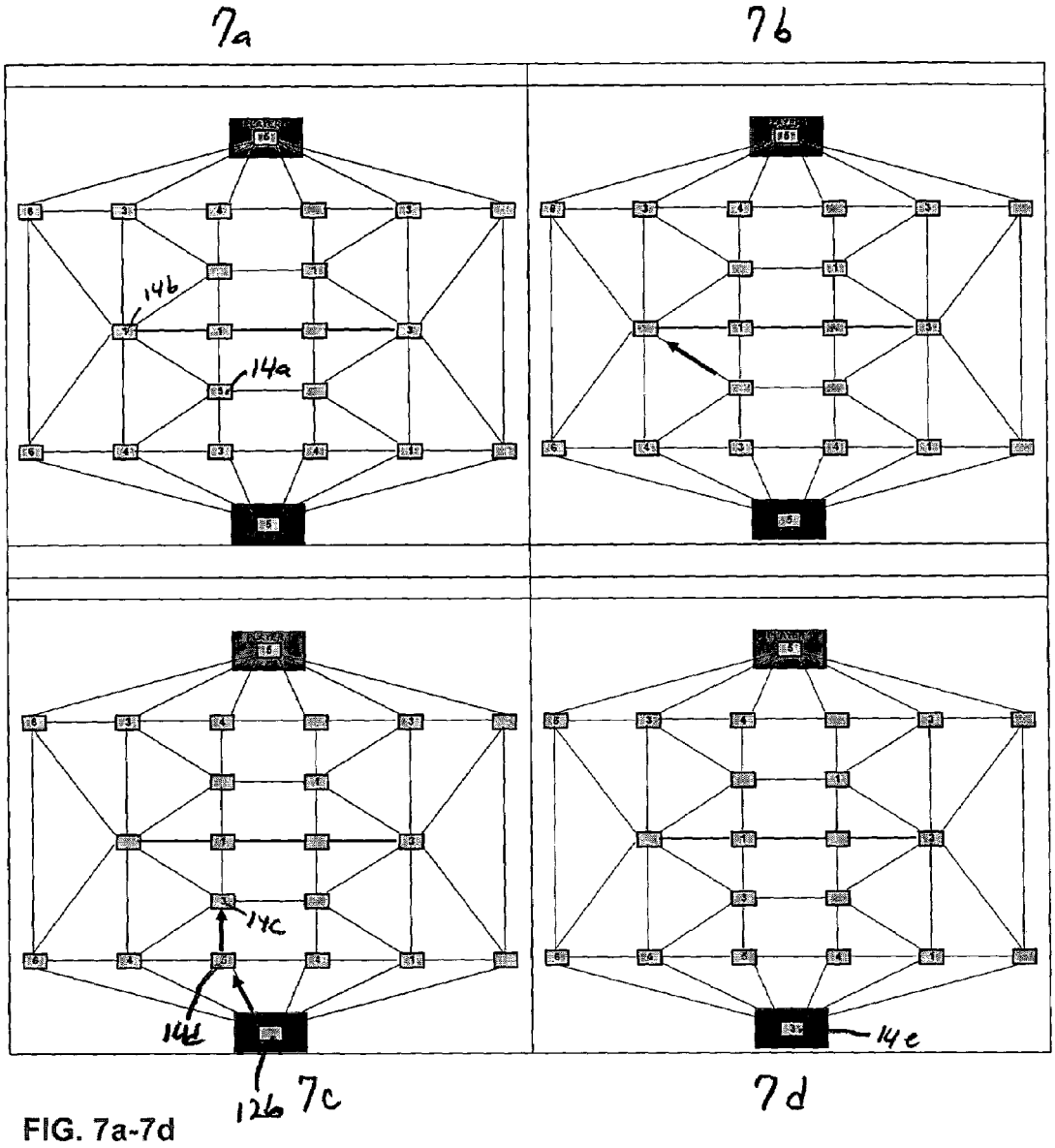
FIGS. 7*a*-7*d* are schematic diagrams of sample moves for an eject.

FIGS. 7*a*-7*d* are schematic diagrams of sample moves for a eject. FIG. 7*a* shows a sample starting position. In FIG. 7*b*, player 2 uses a piece 14*a* which was in eject state (6) to eject player 2's piece 14*b* in neutral state (1) and then piece 14*b* is removed. The node 13*a* is then backfilled with piece 14*c*, and that node is backfilled with piece 14*c* and that node with 14*d* from the source node 12*b*. The player then places piece 14*e* in the source node 12*a*.

Figures 8A, 8B, 8C, 8D:
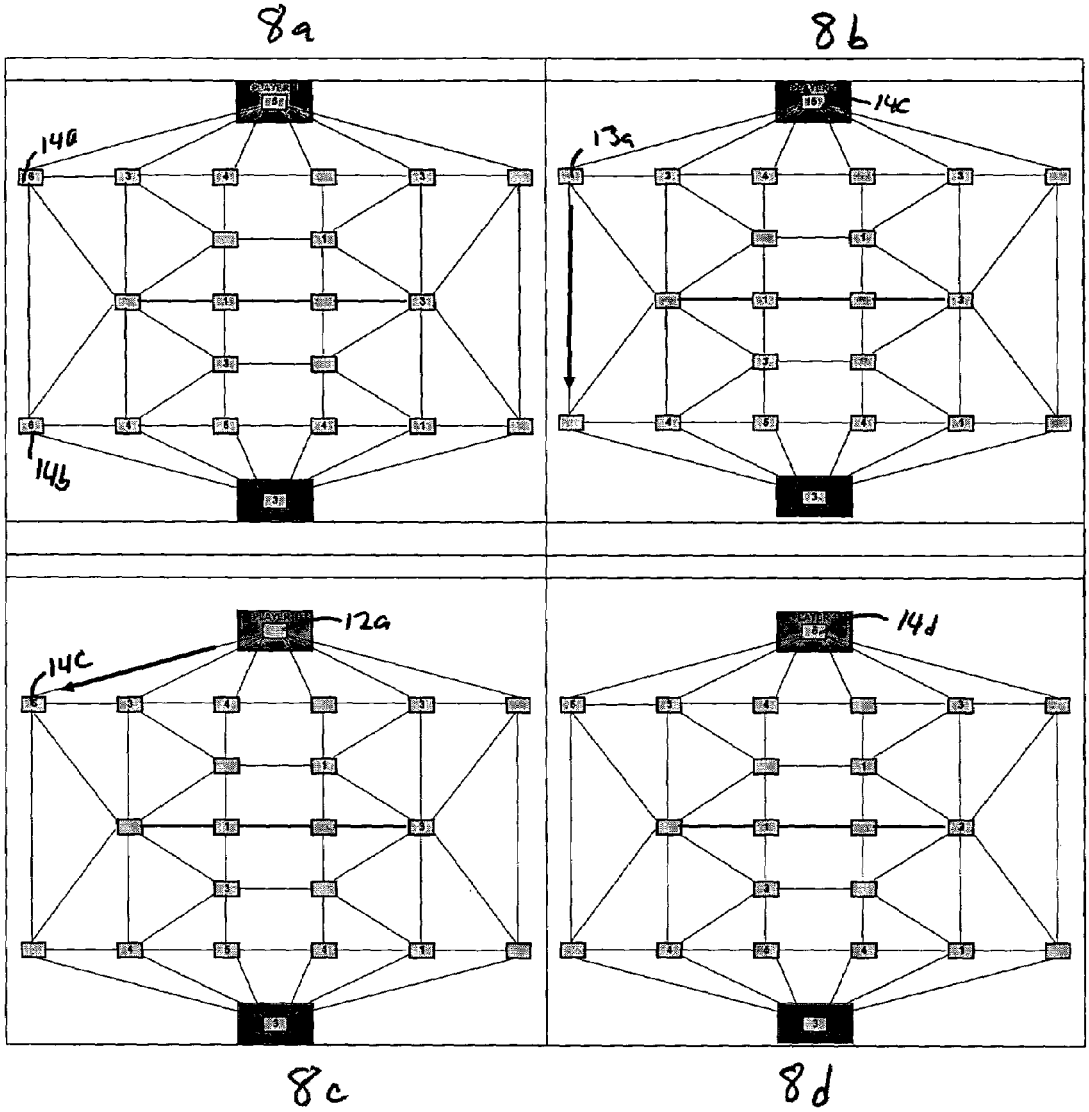
FIGS. 8*a*-8*d* are schematic diagrams of sample moves for a block sacrifice.

FIGS. 8*a*-8*d* are schematic diagrams of sample moves for a block sacrifice. FIG. 8*a* shows a sample starting position. In FIG. 8*b*, player 1 uses a piece 14*a* which was in block state (6) to sacrifice itself to remove a piece 14*b* in block state (6) and then pieces 14*a* and 14*b* are removed. As shown in FIG. 8*c*, the node 13*a* is then backfilled with piece 14*c* from the source node 12*a*. As shown in FIG. 8*d*, the player then places piece 14*d* in the source node 12*a*.

Figures 9A, 9B, 9C, 9D:
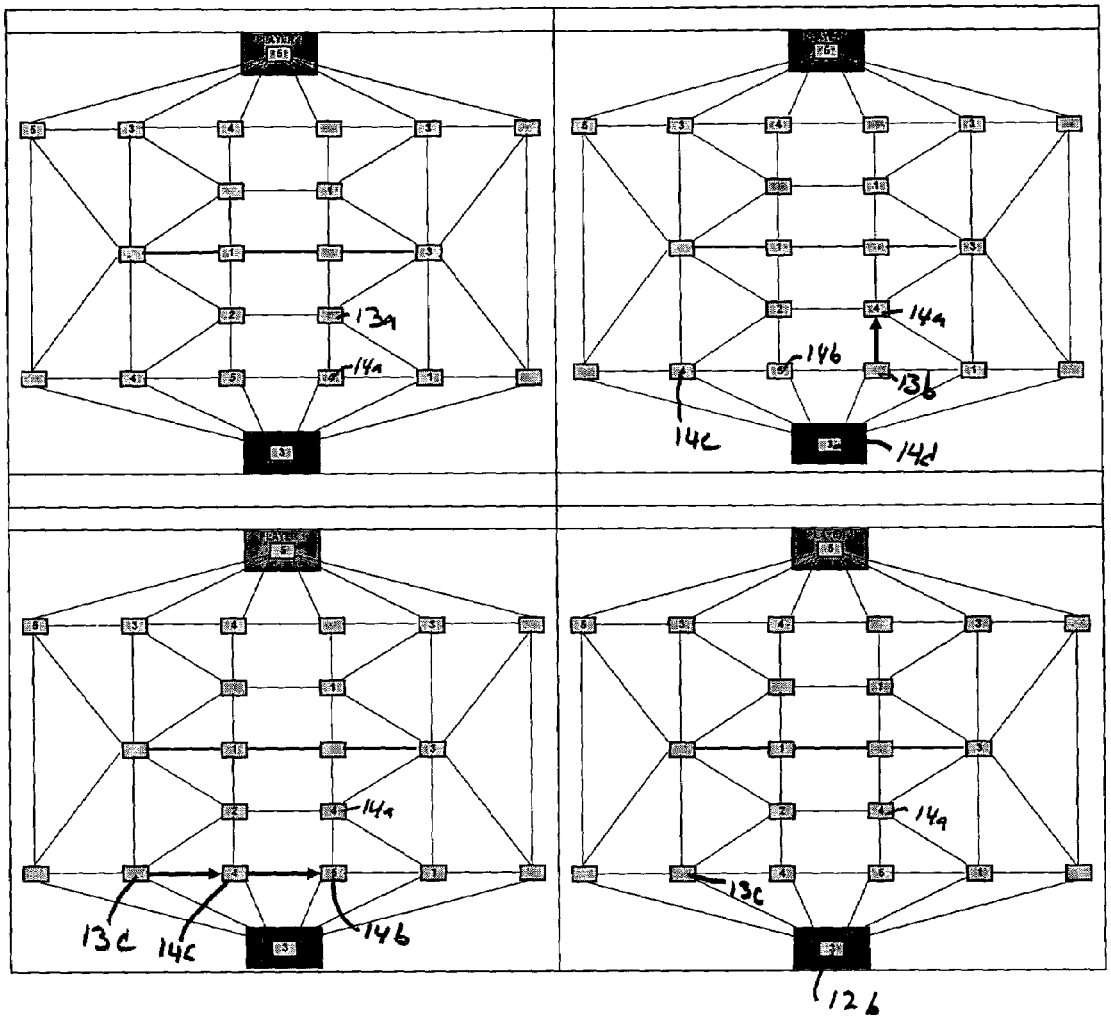
FIGS. 9*a*-9*d* are schematic diagrams of sample moves for a thrust.

FIGS. 9*a*-9*d* are schematic diagrams of sample moves for a thrust. This is the only move which is an exception to the three elements of a move. The thrust move is a special move, which may be chosen as a players turn. FIG. 9*a* shows a sample starting position.

As shown in FIG. 9*b*, a player moves one of the pieces 14*a*, unchanged, into an empty node 13*a* and the back fill process then occurs. With a "Thrust" the first selected piece 14*a* chosen by a player can move into an empty node 13. The subsequent empty node 13*b* left by the piece 14*a* can be filled by the process described above, except that the move ends on an empty node 13*c* adjacent to the Source Node 12*b*. However, the back fill process has to stop somewhere on (but not immediately upon reaching) the player's "Base Line". As the backfill process is required to stop at the "base line", the piece on the source node is not used and therefore can not be replaced during a "Thrust". The player can not move the Source Node piece 14*d* into that empty node 13*c* or change the Source Node piece 14*d* during a turn that has a "Thrust" move. After a "Thrust" an additional empty node 13*c* will be present on the base line.

Figures 10A, 10B, 10C, 10D:
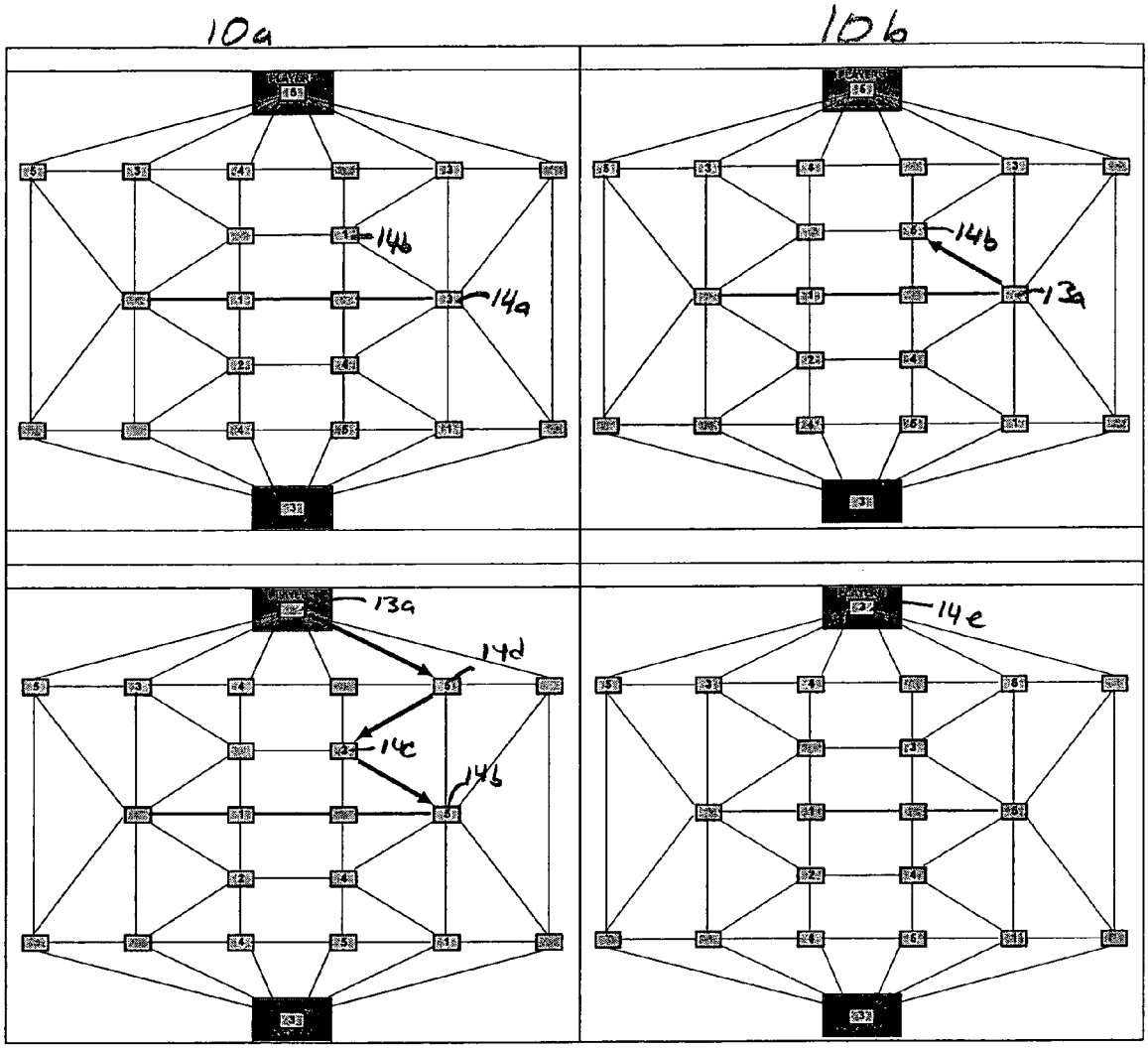
FIGS. 10*a*-10*d* are schematic diagrams of sample moves for a reverse change.

FIGS. 10*a*-10*d* are schematic diagrams of sample moves for a reverse change. FIG. 10*a* shows a sample starting position. In FIG. 10*b*, player 1 uses a piece 14*a* to change piece 14*b* to an Eject state (5) and then piece 14*a* is removed. Piece 14*b* backfills the open node 13*a* and then piece 14*c* backfills that open node, and piece 14*d*, from the source node 12*b* backfills that node as shown in FIG. 10*c*. Then as shown in FIG. 10*d*, the player then places piece 144 in the source node 12*b*.

Figures 11A, 11B, 11C, 11D:
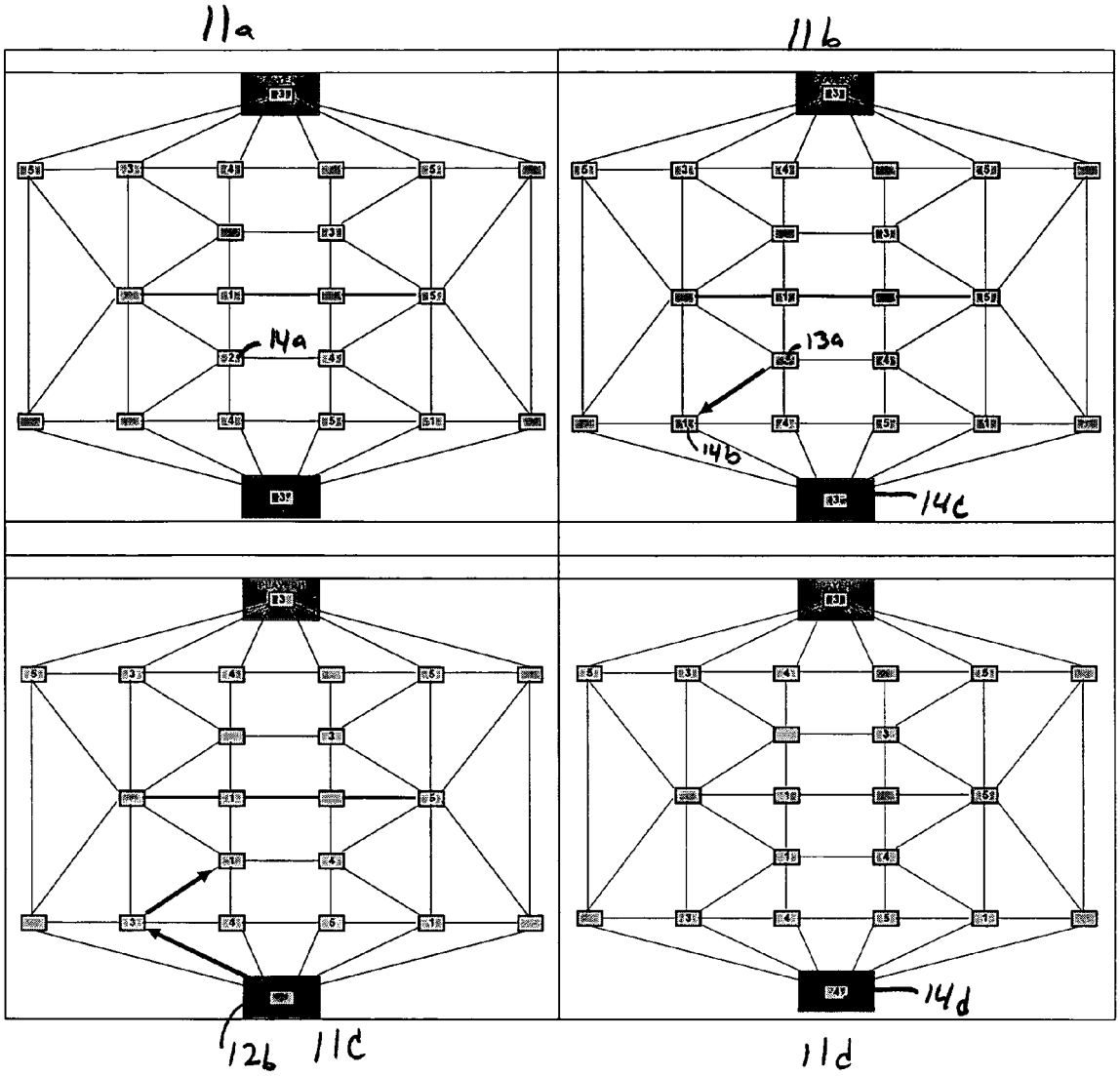
FIGS. 11*a*-11*d* are schematic diagrams of sample moves for a reverse create.

FIGS. 11*a*-11*d* are schematic diagrams of sample moves for a reverse create. FIG. 1*a* shows a sample starting position. In FIG. 11*b*, player 1 uses a piece 14*a* which was in create state (2) to create a piece 14*b* in neutral state (1) and then piece 14*a* is removed. The node 13*a* is then backfilled with piece 14*b*, and that node is backfilled with piece 14*c* from the source node 12*b* as shown in FIG. 11*c*. The player then places piece 14*d* in the source node 12*b*.

In summary, the distance (i.e. number of between of spaces) between each player's Source Node 12 decreases as the rows move from the center to the outside. Each player starts with one piece and grows out from a Source Node 12. The game proceeds with each player trying to neutralize the opponent(s)'s Source Node 12. Every piece 14 is the same but can assume any one of six states, which affects its properties. All pieces 14 in the game move one space at a time per turn. A turn consists of one piece 14 taking an "action" and any number of the player's pieces 14 moving behind it. All pieces 14 in the game have a circumstance where they can be changed to assume a different state and properties. Pieces 14 are added to the board 10 nearly every turn. An opponent has the potential to remove or recruit a player's piece 14 for their own use. For any piece 14 to be played it has to be joined in a continuous line of pieces 14 back to a player's Source Node 12 and so is dependent on the other pieces 14. The game at any one stage offers a finite set of outcomes but as there are pieces 14 being constantly added to the board 10, one piece 14 can change its state each turn and any number of a player's pieces 14 can change positions, the outcomes will change every turn. The only possibility is for a computer to recognize a winning formation just before or once the "attrition" process begins.

The following compares this game to the traditional game of chess.

Qualities—Chess vs. Foil

| CHESS | Game of current application |
|---|---|
| There is a set board and only two players can play. | May be applied to many board configurations for any number of players. |
| The board is a square of 8 × 8 places. | The distance (i.e. number of between of spaces) between each player's "Source Node" decreases as the rows move from the center to the outside. |
| The distance between each player's starting row in constant across the board. | |
| Each player has standard set number of each type of piece at the start of the game. The game proceeds as a process of attrition until one piece - the King - is irreversibly trapped. | Each player starts with one piece and grows out from a "Source Node". The game proceeds with each player trying to neutralize the opponent(s)'s "Source Node". |
| There are six types of pieces - each with different properties. | Every piece is the same but can assume any one of six states, which affects its properties. |
| Each type of piece has a unique and specific way of moving round the board and may, within its limitations, move more that one square at a time | All pieces in the game move one space at a time per turn. |
| A turn consists of one piece making one move. | A turn consists of one piece taking an "action" and any number of the player's pieces moving behind it. |
| No pieces in Chess (except a pawn reaching the opponents starting row) can change its properties. | All pieces in the game have a circumstance where they can be changed to assume a different state and properties. |
| The pieces can only be removed from the board. No pieces are ever replaced. (except the pawn substitution mentioned above). | Pieces are added to the board nearly every turn. |
| Chess only allows pieces to be removed. An opponent can not transform a player's piece into one of their own. | An opponent has the potential to remove or recruit a player's piece for their own use. |
| All pieces move independently and, apart from blocking the way, are not dependent on the other pieces. (An exception would be the King "Castling" with the Rook) | For any piece to be played it has to be joined in a continuous line of pieces back to a player's "Source Node" and so is dependent on the other pieces. |
| Chess can be played by a computer by projecting several moves ahead while considering all possibilities and picking the option with the best outcomes. As the game progresses the number and selection of outcomes becomes smaller and the computer tends to a winning outcome for itself. | The game at any one stage offers a finite set of outcomes but as there is pieces being constantly added to the board, one piece can change its state each turn and any number of a player's pieces can change positions, the outcomes will change every turn. The only possibility is for a computer to recognize a winning formation just before or once the "attrition" process begins. |

The invention claimed is:

1. A method of playing a board game comprising the steps of:

providing a game board, said board comprised of a plurality of nodes;

providing a source node for each player;

providing a plurality of playing pieces, said playing pieces each having a plurality of faces representing states, said playing pieces representing each of the states;

providing predetermined acting abilities to each playing piece, according to the state of each piece;

operating a selected piece by each player, in turn, by having one of the player's playing pieces act on one of another of the player's own pieces, a playing piece of another player, and an empty node, according to its predetermined acting abilities as characterized by its current state;

removing the acting piece;

backfilling the empty node with another of the player's own pieces directly linked to the newly emptied node, and continuing the backfilling consecutively back to the player's source node;

placing a new piece on the player's own source node in any state the player chooses; and repeating the steps of operating, removing, backfilling and placing until one player's piece is removed from the player's source node by the other player.

2. The method of claim 1, wherein one of said states is a neutral state where the piece may do nothing.

3. The method of claim 1, wherein:

one of said states is a create state where the piece creates a new piece on an empty node; and the state of the created piece is neutral.

4. The method of claim 1 wherein one of said states is a change state where the piece changes the players own state to any other state.

5. The method of claim 1 wherein one of said states is a recruit state where the piece changes an opponent's piece to the neutral state.

6. The method of claim 1 wherein one of said states is a eject state where the piece causes an opponent's piece to be removed from the board.

7. The method of claim 1 wherein one of said states is a block state where the piece ejects an opponent's piece of the block state.

8. The method of claim 1 wherein one of said pieces may move into an empty node, and the turn ends after backfilling to an empty node adjacent to the source node.

9. The method of claim 8 wherein, when the one of said pieces moves into the empty node, the piece occupying the source node may not be moved or have it's state changed.

10. The method of claim 1 wherein said pieces are not placed on the board but originate and spread out from the source node.

* * * * *